US005651220A

United States Patent [19]

dit Felix

[11] Patent Number: 5,651,220

[45] Date of Patent: Jul. 29, 1997

[54] SHELTER CONSISTING OF PANELS ASSEMBLED IN A POLYHEDRON

[76] Inventor: Gerard Chamayou dit Felix, 93 rue Broca - 75013, Paris, France

[21] Appl. No.: 725,553

[22] Filed: Oct. 3, 1996

[30] Foreign Application Priority Data

Oct. 6, 1995 [FR] France ..... 9511789

[51] Int. Cl.[6] ..... E04B 1/32; E04B 1/38

[52] U.S. Cl. ..... 52/81.5; 52/79.5; 52/79.9; 52/309.9; 52/285.3; 52/81.1; 52/584.1; 52/586.1; 52/814

[58] Field of Search ..... 52/81.5, 81.4, 52/81.1, 79.5, 79.9, 309.9, 582.1, 584.1, 585.1, 586.1, 285.3, 285.1, 284, 281

[56] References Cited

U.S. PATENT DOCUMENTS 3,432,196 3/1969 Marchiorello ..... 52/584.1
3,763,608 10/1973 Chamlee ..... 52/81.4
4,169,688 10/1979 Toshio ..... 52/586.1 X
4,441,293 4/1984 McQueen et al. ..... 52/586.1 X
4,655,013 4/1987 Ridaud ..... 52/81.4
5,349,796 9/1994 Meyerson ..... 52/309.9 X

*Primary Examiner*—Robert Canfield
*Attorney, Agent, or Firm*—Young & Thompson

[57] ABSTRACT

Shelter, consisting of polygonal panels assembled in a polyhedron, preferably inscribed in a dome or sphere, characterized by panels comprising a waterproof outer facing (1), an intermediate insulating material (2) and an inner facing (3), the panels comprising, around their various edges, edge pieces (4) bearing reliefs (6) and able to be fitted to each other at the desired angle, the panels being held in place against each other by one or more clips (8), each clip (8) straddling the two juxtaposed edge components (4) and locking itself in the reliefs (6).

8 Claims, 2 Drawing Sheets

SHELTER CONSISTING OF PANELS ASSEMBLED IN A POLYHEDRON

The invention relates to shelters in polyhedral shapes for sheltering people or families in emergencies or unstable situations, or for use as a leisure dwelling, or even as temporary offices.

Shelters in the form of concrete hemispherical domes are already known. These shelters are time-consuming and expensive to manufacture and are very difficult to transport. What is more, they are poorly insulated. Polyhedral shelters of generally domed shape consisting of triangular panels assembled together with screw components of the type used in furniture assembly, are also known. These components are expensive and the cutting up of the triangular panels causes waste. Their assembly takes some time.

The object of the invention is to provide shelters that are extremely economical, extremely easy for unqualified personnel to erect and take down, and yet also capable of providing the occupants with comfortable, waterproof and insulated shelter.

The shelter according to the invention, consisting of polygonal panels assembled in a polyhedron, preferably inscribed in a dome or sphere, is characterized by panels comprising a waterproof outer facing, an intermediate insulating material and an inner facing, the panels comprising, around their various edges, edge pieces bearing reliefs and able to be fitted to each other at the desired angle, the panels being held in place against each other by one or more clips, each clip straddling the two juxtaposed edge components and locking itself in the reliefs.

The edge components are preferably inserted, around the edge of the panel, between the outer facing and the inner facing, to which they are fixed. These edge components preferably form a continuous frame forming the entirety of the edges of the polygonal panel.

These edge components or frame components may preferably be provided with locating means, for example tongues or studs to determine the respective positions of the two adjacent panels.

In a highly advantageous way, the clip, which is preferably of metal, is U-shaped with its arms ending in reliefs complementary to the reliefs of the edge components.

These reliefs may, for example, consist of grooves or ribs.

In a highly advantageous way, the inner facing may have slots close to the edge components through which the legs of the U-shaped clips can pass when the clips are being applied and when they are being removed for dismantling.

It is preferable for the panels to be trapeziums. The lower panels may be rectangular if they are set vertically.

Some of the panels may contain an opening for a door and windows and an opening is also left at the top for ventilation.

An example of an embodiment of the invention is described with the aid of the attached drawings.

Figure 1:
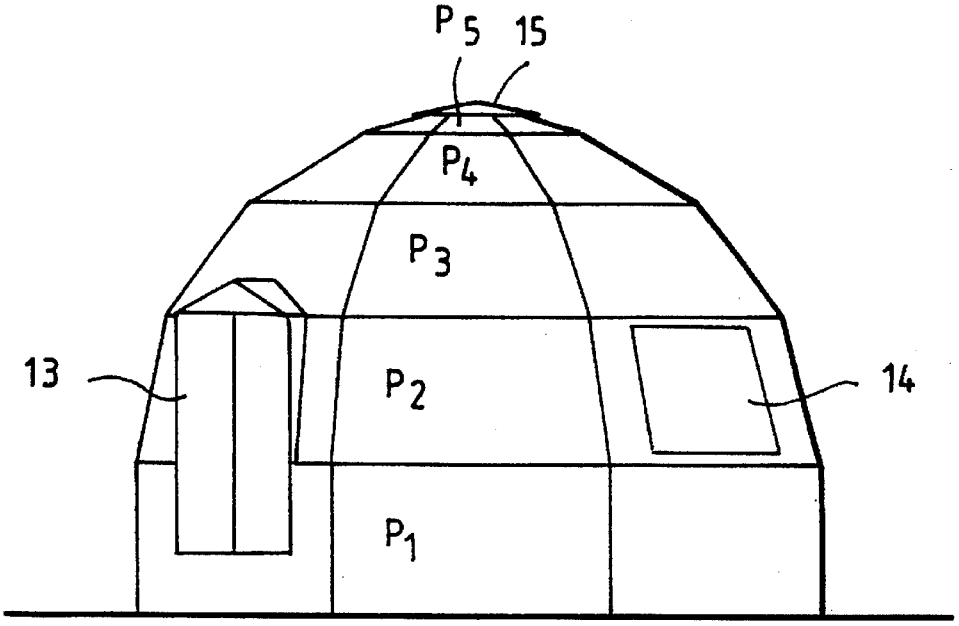
FIG. 1 shows an elevation of a shelter in accordance with the invention.
Figure 2:
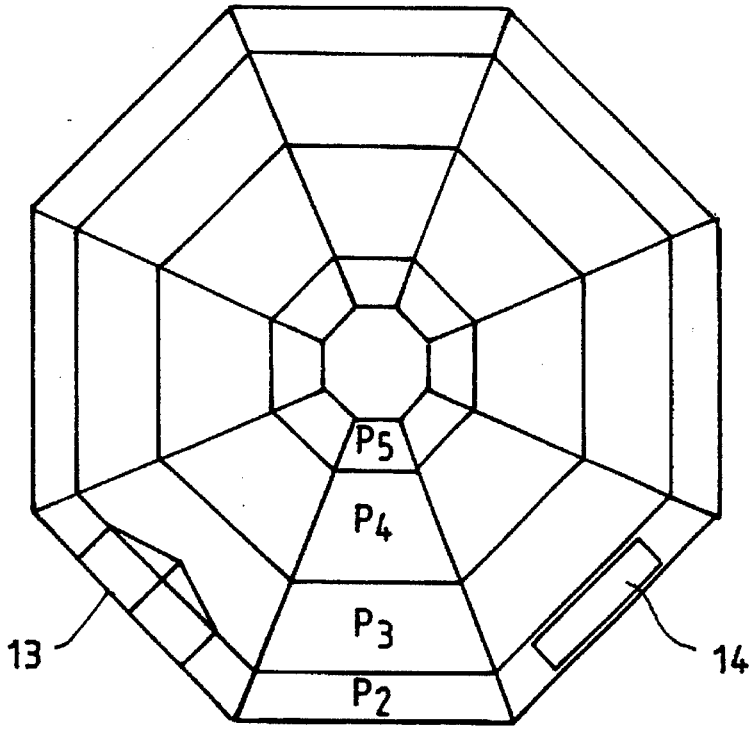
FIG. 2 shows a top view of the shelter.
Figure 3:
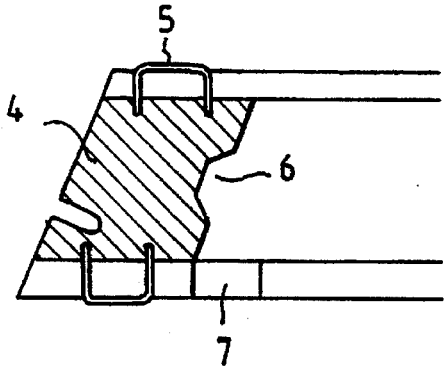
FIG. 3 shows a sectional view through one of the edges of a panel.
Figure 4:
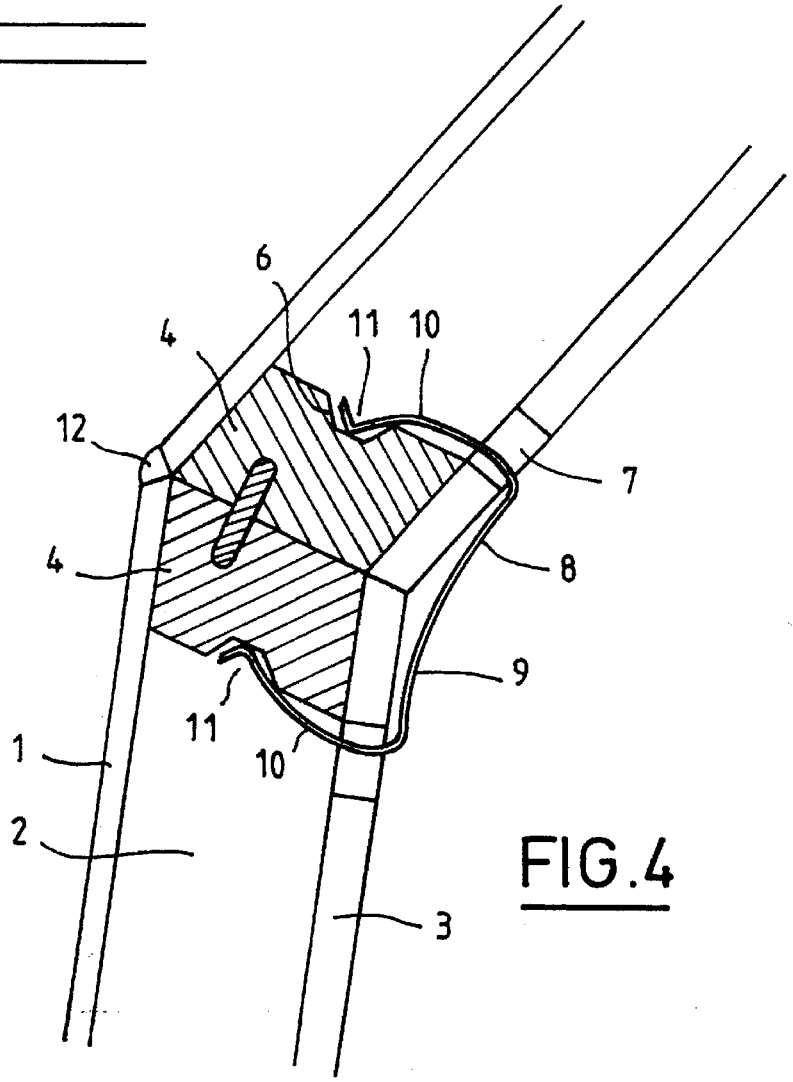
FIG. 4 shows a sectional view through the edges of two panels assembled together.
Figure 5:
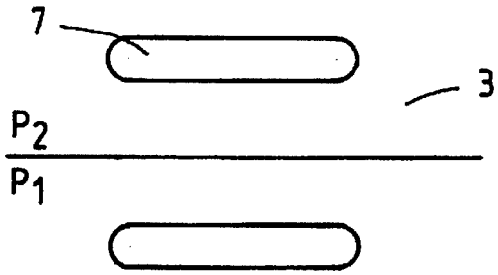
FIG. 5 shows the edges of the inner facings.

The panels of the shelter, in this example, are cut from standard 43 mm-thick panels comprising in succession, from the outside, a 5 mm-thick weatherproof plywood 1, a 30-mm sheet of expanded polystyrene foam 2 and an inner facing 3 made of 8 mm-thick chipboard. These panels are cut into rectangular or trapezium shapes to form five types of panel P1, P2, P3, P4 and P5. The edges of the panels are sawn at an angle that may be easily calculated from the attached drawing, such that the edges of two adjacent panels can be fitted together. These edges are formed by wooden rectangular-sectioned battens 4 inserted between the facings 1 and 3 and glued against these facings, being also reinforced by stainless-steel staples 5. On the inside, that is to say next to the foam, the batten forming the edge component 4 has a longitudinal groove 6. In addition the inner facing 3 has, at intervals, slots 7 adjacent to that face of the batten 4 that includes the groove 6.

It will be understood that the battens 4 thus form a frame that runs all the way around the panel in question, but the battens could also be replaced by shorter pieces arranged at intervals around the edges of the panels.

Assembly is as follows. Two panels, for example panel P1 and panel P2, are placed with their adjacent edges 4 together in the respective positions which they are to occupy definitively. The U-shaped steel clips 8, each with a base 9 and two arms or legs 10, having at their ends a triangular rib 11, are then inserted. The two arms are passed through the two opposing slots 7 until the ribs 11 clip into the grooves 6. It is preferable to use two clips per panel edge. Disassembly is easy, by pulling the clips out.

A seal can be provided between the two adjacent panels by placing a joining piece between the two battens 4, which are pressed against each other by their clips 8. A seal can also be formed simply by means of a silicone mastic 12 in the space between two outer facings 1.

Some of the panels may have an opening for the doors and windows. Two adjacent panels may have openings alongside each other to form the door 13. Windows, which will be glazed and openable, are indicated at 14. At the top a ventilation opening 15 is left between the panels P5 with a trap or other means for keeping out the rain.

To prevent the lower panels P1, which are less well supported than those of the rest of the dome, from coming apart, these panels can be encircled by a hoop (not shown) around the entire perimeter, or fixed firmly to the ground or to the floor.

The floor may be, for example, a concrete slab, or may be constructed in the form of raised wooden planks or sheets of suitable materials secured to an underlying frame to create an underflour space.

Where low weight is a prime consideration, as for example at altitude in the mountains, the wooden components are made of balsa and the folding floor is made up of airtight components inflated with compressed air.

Thanks to their extreme simplicity and rapidity of assembly, the shelters can be erected on site by their users, for example persons without fixed abode or in an unstable situation, after first preparing the area and servicing it.

The various operations of cutting the panels and fitting the frame, and the manufacture of the windows and doors, are simple joinery operations on ordinary machines, which could create jobs for the persons of no fixed abode or in an unstable situation.

I claim:

1. Shelter, consisting of polygonal panels assembled in a polyhedron, characterized by panels comprising a waterproof outer facing (1), an intermediate insulating material (2) and an inner facing (3), the panels comprising, around their various edges, edge components (4) bearing internal reliefs (6) and able to be fitted to each other at a desired angle, the panels being held in place against each other by one or more clips (8), each clip (8) straddling two juxtaposed edge components (4) and locking itself in respective reliefs (6).

2. Shelter according to claim 1, characterized in that the perimeter components are inserted, around the edge of the panels, between the outer facing (1) and the inner facing (3), to which they are fixed.

3. Shelter according to claim 1, characterized in that the edge components form a continuous frame.

4. Shelter according to claim 1, characterized in that the edge components (4) are provided with locating means, such as tongues or studs to determine the respective positions of two adjacent panels.

5. Shelter according to claim 1, characterized in that the one or more clip (8), metal, is U-shaped with its arms (10) ending in reliefs (11) complementary to the reliefs (6) of the edge components.

6. Shelter according to claim 5, characterized in that the inner facings (3) have slots (7) close to the edge components through which the legs of the U-shaped clips can pass when the clips are being applied and when they are being removed for dismantling.

7. Shelter according to claim 1, characterized in that the panels are trapeziums.

8. Shelter according to claim 1, characterized in that some of the panels contain at least one opening for a door or window.

* * * * *

UNITED STATES PATENT AND TRADEMARK OFFICE

CERTIFICATE OF CORRECTION

PATENT NO. : 5,651,220

DATED : July 29, 1997

INVENTOR(S) : Gerard CHAMAYOU dit FELIX

It is certified that error appears in the above-indentified patent and that said Letters Patent is hereby corrected as shown below:

On the title page: Item [19], change the inventor's surname from "dit Felix" to --Chamayou dit Felix--.

Signed and Sealed this

Sixteenth Day of September, 1997

*Attest:*

*Attesting Officer*

BRUCE LEHMAN

*Commissioner of Patents and Trademarks*